US006972515B2

(12) United States Patent
Jeong

(10) Patent No.: US 6,972,515 B2
(45) Date of Patent: Dec. 6, 2005

(54) FLAT TYPE COLOR CATHODE RAY TUBE

(75) Inventor: Hoon Jeong, Gumi (KR)

(73) Assignee: LG. Philips Displays Korea Co., Ltd., Seoul (KR)

( * ) Notice: Subject to any disclaimer, the term of this patent is extended or adjusted under 35 U.S.C. 154(b) by 40 days.

(21) Appl. No.: 10/156,116

(22) Filed: May 29, 2002

(65) Prior Publication Data

US 2003/0111950 A1 Jun. 19, 2003

(30) Foreign Application Priority Data

Dec. 19, 2001 (KR) ..... 2001-81413

(51) Int. Cl.[7] ..... H01J 29/07
(52) U.S. Cl. ..... 313/402; 313/403; 313/408
(58) Field of Search ..... 313/402–408, 313/461–463, 473, 477 R

(56) References Cited

U.S. PATENT DOCUMENTS

| | | | | |
|---|---|---|---|---|
| 3,705,322 A | | 12/1972 | Naruse et al. | 313/85 S |
| 5,155,410 A | * | 10/1992 | Wakasono et al. | 313/402 |
| 5,682,079 A | * | 10/1997 | Kang | 313/461 |
| 5,877,586 A | * | 3/1999 | Aibara | 313/402 |
| 5,917,273 A | * | 6/1999 | Watanabe et al. | 313/402 |
| 6,064,147 A | * | 5/2000 | Hosotani | 313/463 |
| 6,124,668 A | * | 9/2000 | Shoda | 313/403 |
| 6,157,120 A | * | 12/2000 | Tseng et al. | 313/402 |
| 6,160,344 A | * | 12/2000 | Cho et al. | 313/477 R |
| 6,204,599 B1 | * | 3/2001 | Yamazaki | 313/402 |
| 6,342,759 B1 | * | 1/2002 | Hosotani | 313/463 |
| 6,407,490 B1 | * | 6/2002 | Shin et al. | 313/403 |
| 6,411,025 B1 | * | 6/2002 | Bae | 313/408 |
| 6,455,991 B2 | * | 9/2002 | Tsuji | 313/402 |
| 6,455,993 B1 | * | 9/2002 | Ito | 313/408 |
| 6,486,596 B1 | * | 11/2002 | Inoue et al. | 313/402 |
| 6,548,954 B1 | * | 4/2003 | Ishii et al. | 313/467 |
| 6,642,642 B1 | * | 11/2003 | Watanabe et al. | 313/402 |

FOREIGN PATENT DOCUMENTS

| | | |
|---|---|---|
| CN | 1224919 A | 8/1999 |
| CN | 1278652 A | 1/2001 |

OTHER PUBLICATIONS

Chinese Office Action dated Jan. 21, 2005.

* cited by examiner

*Primary Examiner*—Vip Patel
*Assistant Examiner*—Dalei Dong
(74) *Attorney, Agent, or Firm*—Fleshner & Kim, LLP.

(57) ABSTRACT

In a flat type color cathode ray tube, in using of a tint or a dark tint panel capable of improving contrast characteristics of a screen and reducing production processes, namely, having the conventional coating process reduction advantage, by optimizing a horizontal pitch and a transmissivity of a shadow mask and a transmissivity of a screen in order to solve a brightness balance deterioration problem at the circumference portion of the screen due to a glass transmissivity difference, it is possible to maintain inner impact resistance and howling characteristics of the shadow mask, in addition, by improving a circumference portion transmissivity of the shadow mask and a screen transmissivity, it is possible to improve a brightness balance at the circumference portion and a quality of the screen.

24 Claims, 7 Drawing Sheets

FLAT TYPE COLOR CATHODE RAY TUBE

BACKGROUND OF THE INVENTION

1. Field of the Invention

The present invention relates to a flat type color cathode ray tube, and in particular to a flat type color cathode ray tube which is capable of optimizing a horizontal pitch and a shadow mask transmissivity and a screen transmissivity, improving contrast characteristics of a screen and reducing production processes by solving a brightness balance deterioration on the circumstances of the screen due to a glass transmissivity difference and using a tint or a dark tint glass panel not required the conventional coating process.

2. Description of the Prior Art

In general, as depicted in FIG. 1, in a color cathode ray tube, a front glass as a panel 10 is combined with a rear glass as a funnel 20, and they are sealed so as to be in a high vacuum state.

And, the color cathode ray tube includes a fluorescent surface 40 coated onto the internal surface of the panel 10 and performing a luminescent material function, an electron gun 130 emitting an electron beam 60 radiating the fluorescent surface 40, a shadow mask 70 for making the electron beam 60 generated from the electron gun 130 land on a certain surface of the fluorescent surface 40, a frame 30 for fixing/supporting the shadow mask 70, a spring 80 and a stud pin 120 for combining the frame assembly 30 with the panel 10 and an inner shield 90 combined with a certain surface of the frame 30 from the panel side to the funnel side in order to protect the cathode ray tube against terrestrial magnetism.

And, the electron gun 130 is installed to the internal surface of a neck portion 140 of the funnel 20, a deflection yoke 50 for deflecting the electron beam generated from the electron gun 130 in a certain direction is installed to the outer surface of the neck portion 140 of the funnel 20, and a CPM (convergence & purity magnet) for adjusting precisely the deflected direction of the electron beam 60 is included in the cathode ray tube.

And, a reinforcing band 110 is installed to the outer circumference of the portion at which the panel 10 and the funnel are combined in order to protect the panel 10 and the funnel 20 from an air pressure and external impacts.

In the meantime, the electron beam generated from the electron gun 130 of the neck portion 140 of the funnel 20 lands on the fluorescent surface 40 coated onto the internal surface of the panel 10 by a positive voltage applied to the cathode ray tube, herein the electron beam 60 is deflected up, down, left and right by the deflection yoke 50 formed on the outer surface of the funnel 20 before it reaches the fluorescent surface 40.

And, because of the CPM 100 including 2, 4, 6 poles magnets varying a proceeding trajectory of the electron beam in order to land it onto a target fluorescent portion precisely, a color purity defect can be prevented.

In addition, in order to improve contrast characteristics, a certain dyes can be coated onto the outer surface of the panel 10.

The shadow mask 70 has a dome shape maintaining a certain distance from the internal surface of the panel 10, as depicted in FIG. 2, it includes an effective surface 71 having a plurality of dot or stripe-shaped holes 74 at the central portion, a circumference portion 72 surrounding the effective surface 71 and a mask skirt 73 curved from the end portion of the circumference portion 72 almost vertically with respect to the circumference portion 72.

In addition, the shadow mask 70 has a thickness of 0.1~0.3 mm.

And, in the effective surface 71 of the shadow mask 70, the plurality of slots 74 as holes passing the electron beam are formed with a certain arrange, in more detail the dot or stripe-shaped holes 74 are arranged as plural columns having a certain pitch in a vertical or a horizontal direction.

For example, if the electron beam passage holes 74 are striped-slots, as depicted in FIG. 3, each slot 74 on the effective surface 71 of the shadow mask 70 has a rectangular shape having a width (Sw) and a height (Sh), a bridge (Br) is placed between two slots in the vertical direction, a vertical pitch (Pv) is a distance between two slots in the vertical direction, and a horizontal pitch (Ph) is a distance between two slots in the horizontal direction.

Herein, according to variation of an inner radius of curvature of the panel 10, a radius of curvature of the shadow mask 70 maintaining a certain distance from the internal surface of the panel 10 is varied, accordingly the horizontal pitch (Ph) of the shadow mask 70 determining a shape of the shadow mask 70 has a relation to the variation of the inner radius of curvature of the panel 10.

In the conventional color cathode ray tube, an electron beam 60 is radiated from the electron gun 130 installed to the end of the funnel 20, is deflected up, down, left and right by the deflection yoke 60 installed to the outer surface of the funnel 20 before reaching the fluorescent surface 40 of the shadow mask 70, passes the shadow mask 70 having the plurality of holes, lands on the fluorescent surface 40 formed on the internal surface of the panel 10 and radiates, accordingly a picture is reproduced.

In more detail, three electron beams 60 are deflected up, down, left and right according to a certain signal by the deflection yoke 50, pass the electron beam passage holes of the shadow mask 70, land on the R, G, B fluorescent surface 40 and radiate R, G, B on the internal surface of the panel 10. A picture through a combination of the radiated R, G, B three lights passes the panel 10 made of a glass material having a certain thickness and is showed in eyesight. Herein, a fluorescence (brightness) difference occurs according to a transmissivity of the shadow mask 70, a transmissivity of the fluorescent surface of the panel 10 (hereinafter, it is referred to as a 'screen transmissivity') and a glass transmissivity of the panel 10.

In the meantime, a contrast of the picture displayed through the above-mentioned processes is determined according to contrast distinction.

In order to improve the contrast characteristics, a certain dyes are coated onto the outer surface of the panel 10.

After coating, in the comparison with a screen skipping the coating process, a dark portion is darker and a bright portion is brighter on the screen (passing the coating process), accordingly the contrast characteristics are improved.

In the meantime, FIGS. 4A and 4B illustrate shapes of the panel 11 having both inner and outer radius of curvatures and a flat type panel 12 almost not having an outer radius of curvature.

In general, a wedge rate means a circumference portion glass thickness in the comparison with a central portion glass thickness of the panel, as depicted in FIG. 4B, the flatter the outer surface of the panel, the more the wedge rate increases.

In more detail, the internal surface of the panel has a certain radius of curvature as a dome shape and the outer surface of the panel is almost flat, accordingly the more the thickness of the circumference portion of the panel, the more the glass wedge rate increases.

In addition, the outer surface of the panel is flat (almost not having an outer radius of curvature), the inner surface of the panel has a radius of curvature, accordingly the thicker the panel, the less the glass transmissivity of the panel decreases.

Accordingly, the panel has to use a clear glass having a high transmissivity as its material.

In that case, a fluorescence (brightness) characteristic can be improved, however a contrast characteristic meaning a distinction according to a screen brightness deteriorates, in order to compensate it, a black dyes having a transmissivity of 60%~80% is coated onto the outer surface of the panel.

By coating it, the contrast characteristic can be improved by making a dark portion darker. However, it means an additional coating process which is generally not necessary to a non-flat type color cathode ray tube has to be performed, accordingly problems such as additional production cost, difficulties in managing increased production processes and reduction of a yield rate occur.

In order to solve the above-mentioned problems and improve the contrast characteristic, a flat type color cathode ray tube using a panel made of a tint glass or a dark tint glass has been fabricated.

However, in the conventional flat type color cathode ray tube made of a clear glass and having a wedge rate of 200%, as shown in Table 1, in a panel having a thickness of 12.5 mm at the central portion and a wedge rate of 200%, a clear glass has a transmissivity of 80% at the central portion and 70% at the circumference portion, and a tint glass has a transmissivity of 51% at the central portion and 27% at the circumference portion. Herein, in the tint glass, the transmissivity at the circumference portion is sharply reduced in the comparison with that of the central portion, accordingly a brightness balance between the central portion and the circumference portion is very bad.

TABLE 1

| | CENTRAL PORTION (%) | CIRCUMFERENCE PORTION (%) |
|---|---|---|
| CLEAR GLASS | 80 | 70 |
| TINT GLASS | 51 | 27 |
| DARK TINT GLASS | 40 | 18 |

As shown in Table 1, the electron beam 60 radiated from the electron gun 130 passes the holes 74 of the shadow mask 70, herein a transmissivity of the shadow mask 70 is about 14%~19%.

And, the electron beam 60 passing the shadow mask 70 passes the fluorescent surface 40 coated onto the internal surface of the panel 10, a transmissivity of a screen is about 45%~60%.

And, the electron beam 60 passes the panel 10 having a certain thickness and made of a glass material and finally reaches in eyesight.

Accordingly, in order to solve a brightness balance deterioration due to a sharp reduction of a transmissivity at the circumference portion and reduce a breakage rate in a thermal processing simultaneously, a wedge rate (the circumference portion glass thickness in the comparison with the central portion glass thickness of the panel) is reduced from 200% to 180%~190%.

In more detail, by reducing a glass thickness at the circumference portion, a transmissivity at the circumference portion of the glass is improved.

However, as described above, by reducing the wedge rate, the internal surface of the panel 10 is getting flat, in other words, a radius of curvature increases, a radius of curvature of the shadow mask 70 having a dome shape and maintaining a certain distance from the internal surface of the panel 10 is related to the variation of the inner radius of curvature of the panel 10.

Accordingly, because the inner radius of curvature of the panel 10 is a main factor determining a howling characteristic according to a structural stiffness, internal impact resistance and external impact resistance of the shadow mask 70, a wedge rate of the panel 10 can not be reduced infinitely.

In general, when a horizontal pitch (Ph) of the shadow mask increases, the radius of curvature of the shadow mask 70 decreases, when the horizontal pitch (Ph) of the shadow mask decreases, the radius of curvature of the shadow mask 70 increases. Accordingly, the radius of curvature of the shadow mask 70 is in inverse proportion to the horizontal pitch (Ph) of the shadow mask 70.

Accordingly, in order to increase a radius of curvature of the panel 10, a radius of curvature of the shadow mask 70 has to increase, herein a structure of the horizontal pitch (Ph) of the shadow mask 70 has to be changed. In more detail, a new structure has to be capable of minimizing deterioration of a radius of curvature and improving a transmissivity of the shadow mask 70.

In more detail, as shown in Table 1, when a tint glass or a dark tint glass is used, a transmissivity at the circumference portion is sharply lowered, in order to improve it, a wedge rate can be reduced, however there is a limit in reducing a wedge rate, accordingly decreased transmissivity at the circumference portion can not be sufficiently improved only with a wedge rate decrease of the glass.

SUMMARY OF THE INVENTION

Accordingly, in order to improve the above-mentioned problems, it is an object of the present invention to provide a flat type color cathode ray tube which is capable of solving a brightness balance deterioration problem at the circumference portion of a screen due to a transmissivity difference according to a glass wedge rate in using of a tint glass panel or a dark tint glass panel in order to improve a contrast characteristic.

In order to achieve the above-mentioned object, in a flat type color cathode ray tube including a rectangular panel having an almost flat outer surface and an inner surface having a certain radius of curvature, a funnel installed to the rear of the panel, a fluorescent surface coated onto the internal surface of the panel and performing a certain fluorescence function, an electron gun discharging electron beams radiating the fluorescent surface, a shadow mask for making the electron beams from the electron gun land on a certain portion of the fluorescent surface, a frame for fixing/supporting the shadow mask, a spring and a stud pin for combining the frame assembly with the panel, an inner shield combined with the certain side of the frame from the panel side to the funnel side in order to protect the cathode ray tube against a terrestrial magnetism, an electron gun placed inside a neck portion of the funnel and generating the electron beams, a deflection yoke installed to the outer surface of the neck portion of the funnel in order to deflect the electron beams from the electron gun in a certain direction, a CPM (convergence & purity magnet) for precisely adjusting the deflected direction of the electron beams and a reinforcing band installed to the outer circumference of the portion at which the panel and the funnel are combined in order to protect the panel and the funnel against an air pressure and external impacts, wherein a flat type color cathode ray tube satisfies $$1.2 \leqq Ph_H/Ph \leqq 1.6,$$

$$1.2 \leqq Ph_D/Ph_C \leqq 1.6$$

when a central portion glass transmissivity of the panel is about 45%~75%, a radius of curvature in the diagonal direction ($Rp_D$) of the panel has a range of $3.5\ R \leqq Rp_D \leqq 8.0\ R$ (R is calculated by multiplying 1.767 by an effective surface diagonal axis length of the panel), a horizontal pitch of an electron beam passage hole at the central portion of the shadow mask is $Ph_C$, a horizontal pitch of the outmost electron beam passage hole in the long axis direction is $Ph_H$, a horizontal pitch of the outmost electron beam passage hole in the short axis direction is $Ph_V$ and a horizontal pitch of the outmost electron beam passage hole in the diagonal axis direction is $Ph_D$.

In addition, a flat type color cathode ray tube including a rectangular panel having an almost flat outer surface and an inner surface of a certain radius of curvature, a funnel installed to the rear of the panel, a fluorescent surface coated onto the internal surface of the panel and performing a certain fluorescence function, an electron gun discharging electron beams radiating the fluorescent surface, a shadow mask for making the electron beams from the electron gun land on a certain portion of the fluorescent surface, a frame for fixing/supporting the shadow mask, a spring and stud pin for combining the frame assembly with the panel, an inner shield combined with the certain side of the frame from the panel side to the funnel side in order to protect the cathode ray tube against a terrestrial magnetism, an electron gun placed inside a neck portion of the funnel and generating the electron beams, a deflection yoke installed to the outer surface of the neck portion of the funnel in order to deflect the electron beams from the electron gun in a certain direction, a CPM (convergence & purity magnet) for precisely adjusting the deflected direction of the electron beams and a reinforcing band installed to the outer circumference of the portion at which the panel and the funnel are combined in order to protect the panel and the funnel against an air pressure and external impacts, wherein a flat type color cathode ray tube satisfies $$0.80 \leqq Ts_D/Ts_C \leqq 1.20$$

when a central portion glass transmissivity of the panel is about 45%~75%, a radius of curvature in the diagonal direction ($Rp_D$) of the panel is within a range of $3.5\ R \leqq Rp_D \leqq 8.0\ R$ (R is calculated by multiplying 1.767 by an effective surface diagonal axis length of the panel), a circumference portion screen transimissivity is $Ts_D$ and a central portion screen transmissivity of the effective surface of the panel is $Ts_C$.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
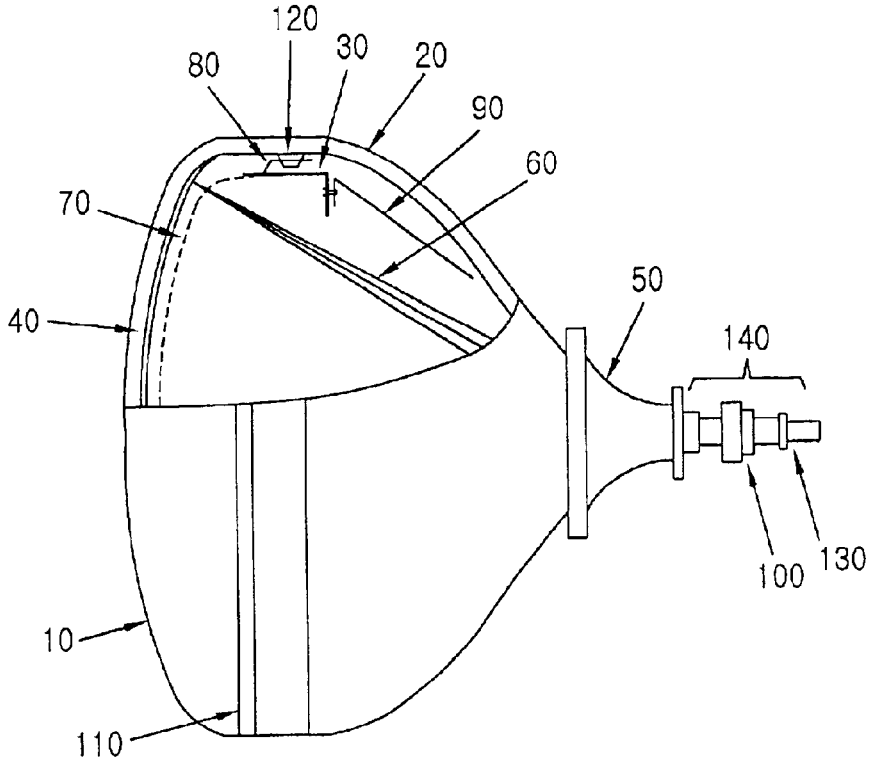
FIG. 1 CONVENTIONAL ART
FIG. 1 is a sectional view illustrating a general cathode ray tube.
Figure 2:
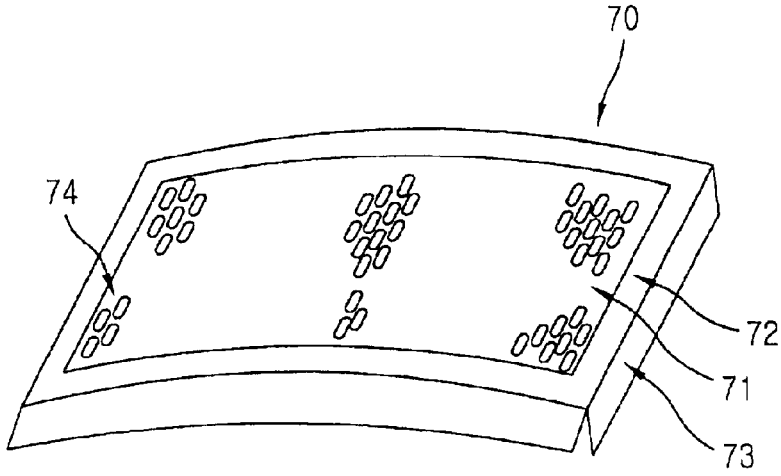
FIG. 2 CONVENTIONAL ART
FIG. 2 is a perspective view illustrating a structure of a shadow mask.
Figure 3:
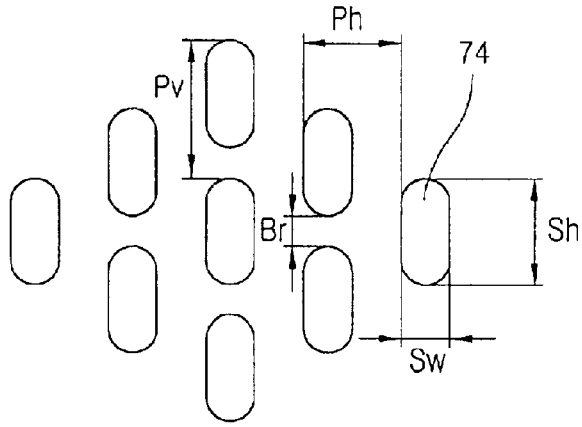
FIG. 3 CONVENTIONAL ART
FIG. 3 is a perspective view illustrating a structure of an electron beam passage hole of a shadow mask.

Hereinafter, the preferred embodiment of the present invention will be described with reference to accompanying drawings.

In general, when a tint or a dark tint glass is used for a flat type color cathode ray tube, because a transmissivity at the circumference portion is sharply reduced, a brightness balance (the center: the circumference) deteriorates.

As described above, an electron beam radiated from an electron gun passes an electron beam passage hole of the shadow mask, herein a transmissivity of the shadow mask is about 14%~19%. The electron beam passing the shadow mask passes a fluorescent surface coated onto the internal surface of the panel, herein a transmissivity of the shadow mask is about 45%~60%. Finally, the electron beam passes the panel made of a glass material and reaches in eyesight, herein a tint has a glass transmissivity of 27%~50% as shown in Table 1.

While passing the above-mentioned portions, a brightness balance deteriorates, and a transmissivity at the circumference portion is always lower than a transmissivity at the central portion.

Accordingly, in order to compensate it, in the conventional art a method for reducing a wedge rate of a glass is used, however it causes a howling characteristic lowering due to decrease of a structural stiffness, internal impact resistance and external impact resistance of a shadow mask.

Accordingly, a structure having a high transmissivity at the circumference portion of the shadow mask and maintaining a stiffness characteristic of the shadow mask and a high transmissivity at the circumference portion of a screen as a fluorescent surface consisting of black matrixes and fluorescent stripes is provided.

Herein, an optimum horizontal pitch and fluorescent stripe width of the shadow mask have to be presented by considering a purity margin in which the electron beam does not land on a target fluorescent stripe but lands on other fluorescent stripe.

In more detail, in the conventional flat type color cathode ray tube using a clear glass panel, when a tint or a dark tint glass panel is used, an optimum mask horizontal pitch of a shadow mask and a screen transmissivity for solving a brightness balance deterioration problem at the circumference portion of a screen due to a glass transmissivity difference will be presented.

The present invention is applied to a flat type color cathode ray tube including a rectangular panel having an almost flat outer surface, a radius of curvature in a diagonal direction ($Rp_D$) of $3.5 \leqq Rp_D \leqq 8.0$ R and a central portion glass transmissivity of 45%~75% and a shadow mask having a plurality of electron beam passage holes formed at the internal surface of the panel at a certain interval.

In particular, it is preferable to apply the present invention to a large size flat type color cathode ray tube having a diagonal length not less than 55 cm.

First, a radius of curvature of the shadow mask will be described.

In general, a radius of curvature of the shadow mask maintaining a certain distance from the internal surface of the panel and having a dome shape is varied according to an inner radius of curvature of the panel, in more detail, a stiffness characteristic of the shadow mask is under the influence of the radius of curvature of the shadow mask.

Below Table 2 and FIG. 5 describe a limit impact quantity relation according to a radius of curvature of the shadow mask.

TABLE 2

| RADIUS OF CURVATURE $Rm_D$ (R) | LIMIT IMPACT QUANTITY (G) |
|---|---|
| 2.21 | 19 |
| 2.12 | 20 |
| 2.04 | 21 |
| 1.97 | 22 |
| 1.90 | 23 |

Figure 5:
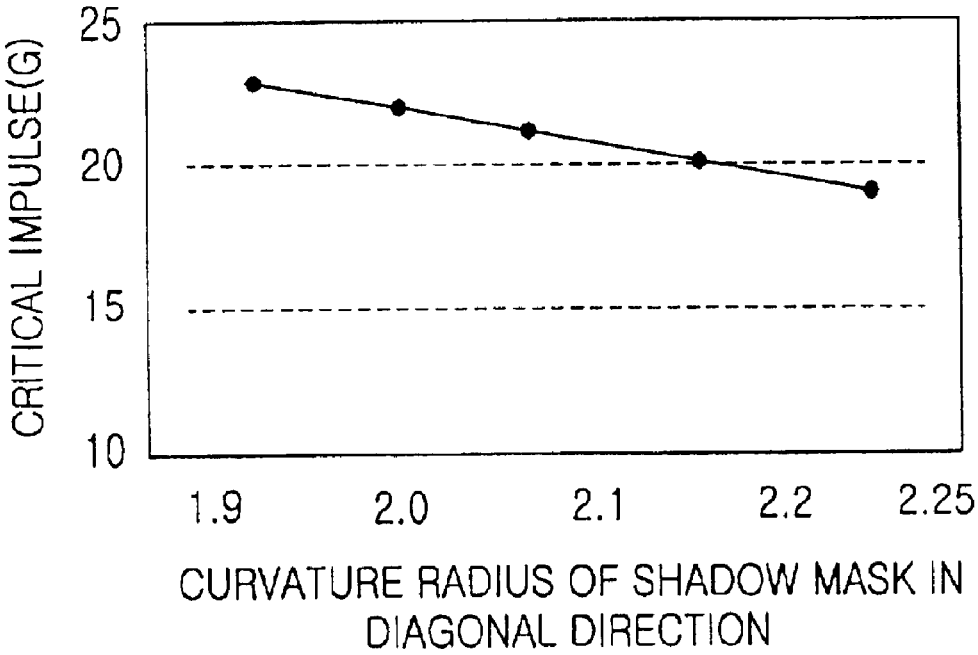
FIG. 5 CONVENTIONAL ART
FIG. 5 is a graph illustrating a range of a radius of curvature of a shadow mask and a maximum external impact quantity (limit impact quantity)

In Table 2 and a graph of FIG. 5, when a shadow mask has a certain radius of curvature in a diagonal axis direction, a maximum external impact quantity maintainable a howling characteristic and an internal impact resistance characteristic of the shadow mask is described, herein G is a unit of an impact quantity, the higher the limit impact quantity, the more the stiffness of the shadow mask has to increase. In order to achieve it, a radius of curvature of the shadow mask has to be small.

In the conventional 29 inches flat type color cathode ray tube, there is no deformation in a shadow mask and there is little color spread phenomenon in a screen due to impacts until an external impact quantity reaches about 20~21 G, accordingly a general flat type color cathode ray tube has to have a limit impact quantity not less than 20 G in minimum in order to satisfy the inner impact stiffness and a howling characteristic due to external impacts of the shadow mask.

Accordingly, as shown in experiment data in Table 2, when a radius of curvature of the shadow mask in the diagonal axis is not greater than 2.12 R, a limit impact quantity is not less than 20 G.

Accordingly, when an external impact is not less than 20 G, a radius of curvature of the shadow mask has to be secured not to have variation of characteristics of a screen due to deformation of the shadow mask or howling.

Accordingly, a radius of curvature of the shadow mask in the diagonal direction $Rm_D$ is not greater than 2.1 R.

In addition, the less the radius of curvature of the short axis direction than a radius of curvature in the long axis or diagonal axis direction, the more the shadow mask has stable characteristics, when a radius of curvature in the long axis direction of the shadow mask is $Rm_H$, a radius of curvature in the short axis direction of the shadow mask is $Rm_V$ and a radius of curvature in the diagonal axis direction of the shadow mask is $Rm_D$, the shadow mask satisfies $Rm_V \leqq Rm_D \leqq Rm_H$.

Figure 6A:
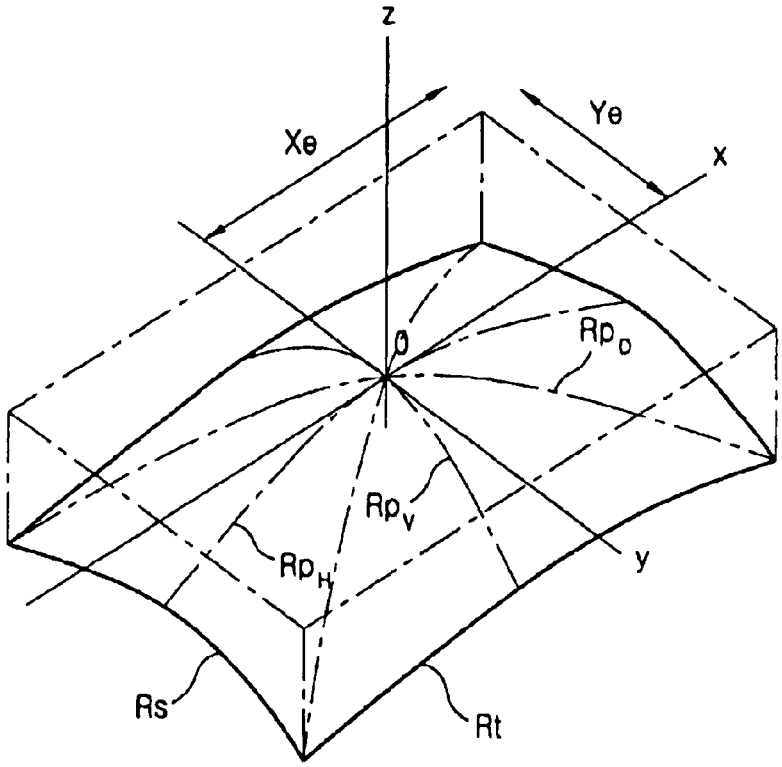
FIG. 6A CONVENTIONAL ART
FIG. 6A is an exemplary view illustrating a radius of curvature in a long axis, a short axis and a diagonal axis of a panel.
Figure 6B:
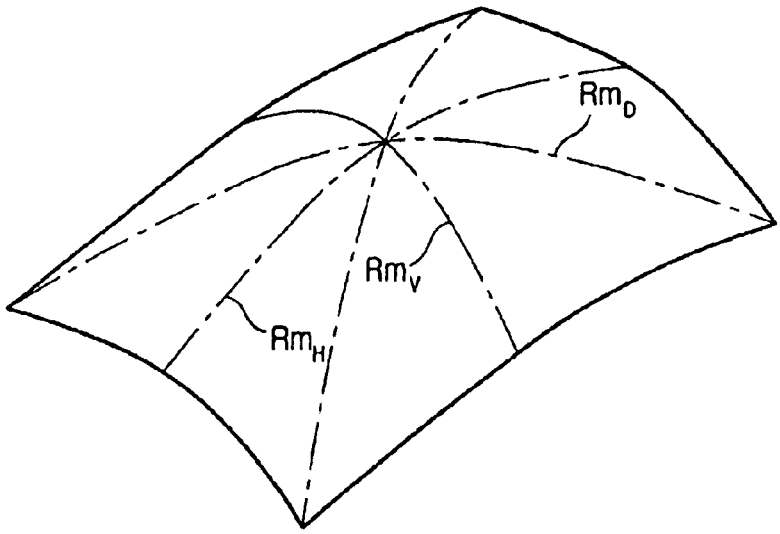
FIG. 6B CONVENTIONAL ART
FIG. 6B is an exemplary view illustrating a radius of curvature in a long axis, a short axis, and a diagonal axis of a shadow mask.

FIG. 6A is an exemplary view illustrating a radius of curvature of the panel in the long axis, short axis and diagonal axis directions. FIG. 6B is an exemplary view illustrating a radius of curvature of the shadow mask in the long axis, short axis and diagonal axis directions.

An electron beam transmissivity at the circumference portion of the shadow mask 70 will be described.

First, in order to use a tint or a dark tint glass having a central portion glass transmissivity of 45%~75% in a flat type color cathode ray tube, as shown in Table 1, decrease of a transmissivity at the circumference portion of the panel has to be compensated.

Accordingly, a wedge rate of a glass used for the conventional clear glass panel is about 200%, it is difficult to have a similar brightness quality as the conventional circumference portion only by reducing a wedge rate so as to be less than 170%~200% by using a tint or a dark tint glass panel.

In order to solve the above-mentioned problem, it is preferable to increase a transmissivity at the circumference portion. It is more preferable to increase a screen transmissivity while increasing a transmissivity at the circumference portion.

Figure 4A:
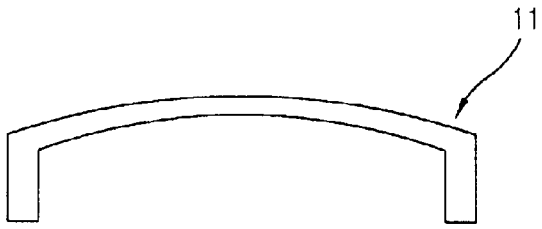
FIG. 4A CONVENTIONAL ART
FIG. 4A is a perspective view illustrating a shape of a non-flat type panel.
Figure 4B:
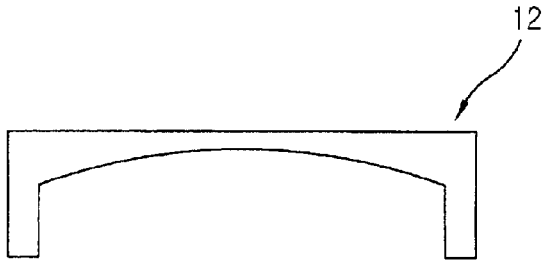
FIG. 4B CONVENTIONAL ART
FIG. 4B is a perspective view illustrating a shape of a flat type panel.

As depicted in FIG. 4, the shadow mask transmissivity is a rate of the area of the electron beam passage hole calculated by multiplying the horizontal width (Sw) to the vertical height (Sh) in the comparison with the area of the shadow mask calculated by multiplying the horizontal pitch (Ph) to the vertical pitch (Pv).

Figure 7A:
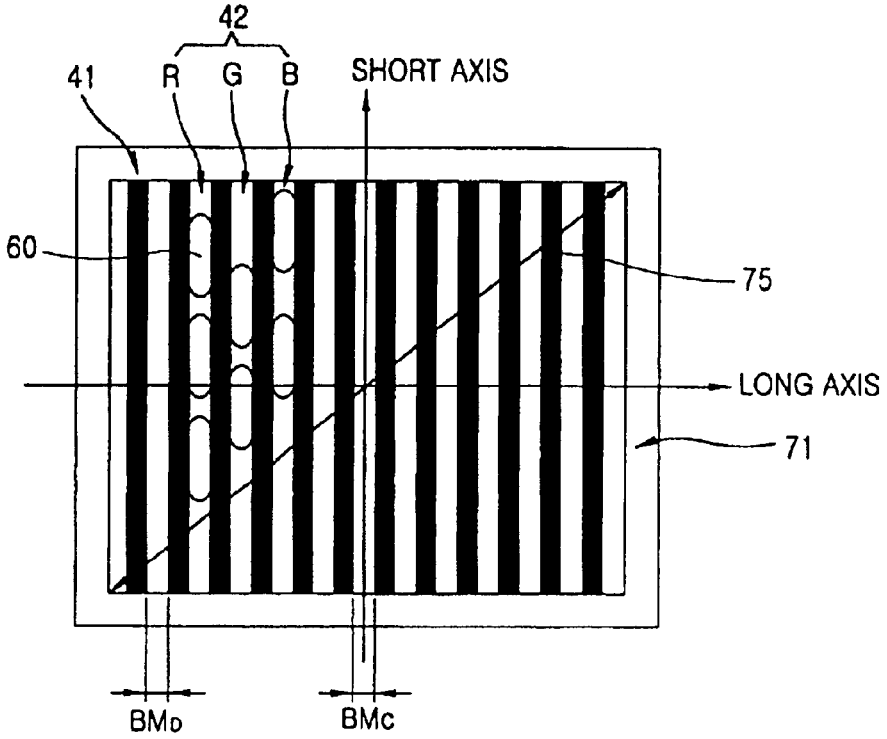
FIG. 7A CONVENTIONAL ART
FIG. 7A illustrates a structure of a fluorescent surface coated onto the internal surface of a panel.
Figure 7B:
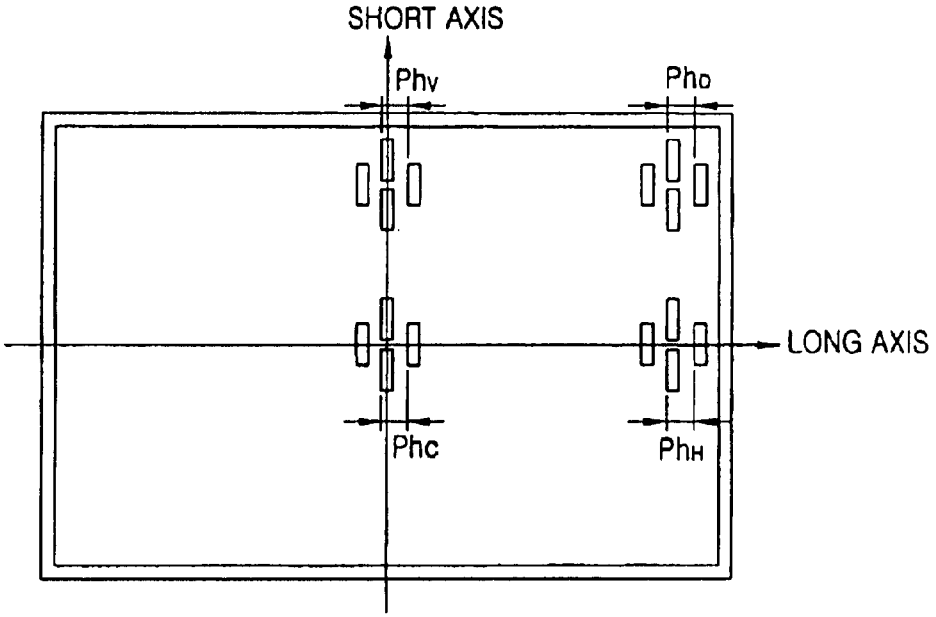
FIG. 7B CONVENTIONAL ART
FIG. 7B illustrates electron beam hole pitch at various positions on the shadow mask.

FIG. 7B illustrates electron beam hole pitch at various positions on the shadow mask;

In general, there are two methods for improving a transmissivity of the shadow mask, one method is increasing an area of each electron beam passage hole while increasing a horizontal pitch at the circumference portion of the shadow mask, and the other method is increasing an area of the electron beam passage hole while decreasing or maintaining a horizontal pitch at the circumference portion of the shadow mask.

However, in the latter, when a horizontal pitch of the shadow mask is reduced, a radius of curvature of the shadow mask increases (the more the shadow mask is flat), it is inefficient in the stiffness aspects, accordingly it is more preferable to use the former method.

Accordingly, by increasing a horizontal pitch value at the circumference portion of a shadow mask, a transmissivity at the circumference portion of the shadow mask can be improved.

In addition, by increasing a horizontal pitch increase ratio at the circumference portion than that of the central portion of the shadow mask, a transmissivity of the shadow mask can be improved.

In more detail, a horizontal pitch at the electron beam passage hole at the central portion of the shadow mask is $Ph_C$, a horizontal pitch of the outmost electron beam passage hole in the long axis direction is $Ph_H$, a horizontal pitch of the outmost electron beam passage hole in the short axis direction is $Ph_V$, a horizontal pitch of the outmost electron beam passage hole in the diagonal axis direction is $Ph_D$, the shadow mask satisfies 0.67 mm$\leqq Ph_C \leqq$0.8 mm, $1.2 \leqq Ph_H/Ph_C \leqq 1.6$ and $1.2 \leqq Ph_D/Ph_C < 1.6$.

Figure 8A:
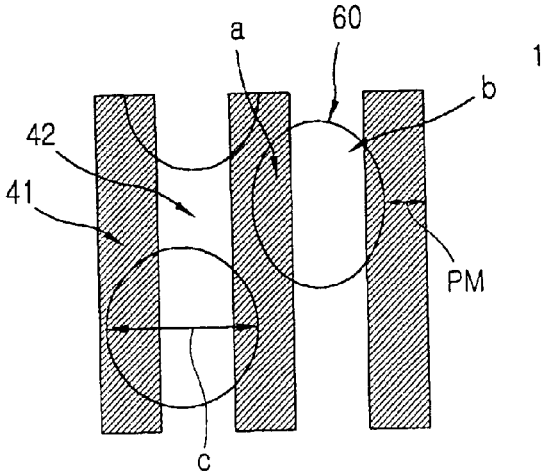
FIG. 8A CONVENTIONAL ART
FIG. 8A is an enlarged view illustrating a fluorescent surface coated onto the internal surface of the panel and an electron beam.
Figure 8B:
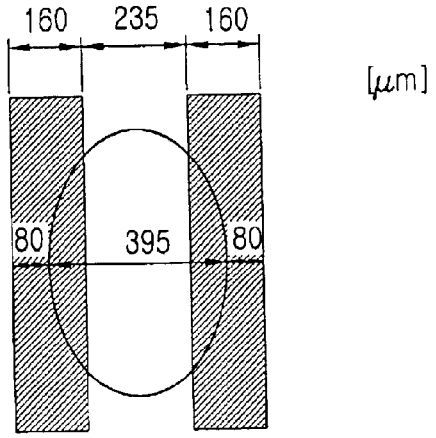
FIG. 8B CONVENTIONAL ART
FIG. 8B is a perspective view illustrating an example of a purity margin.

However, when the horizontal pitch ($Ph_C$) at the central portion of the shadow mask 70 is not greater than 0.67 mm, as depicted in FIGS. 8A and 8B, a width of a black matrix 41, stripe 42 and a purity margin (PM), etc. are reduced, accordingly a yield rate is radically reduced. In a 32" flat type color cathode ray tube having a central portion horizontal pitch of 0.67 mm, its yield rate is lowered about 7~10% in the comparison with that of 25" and 29" flat type color cathode ray tube.

Below Table 3 describes the central portion vertical pitch ($Ph_C$) of the shadow mask and the outmost horizontal pitch ($Ph_D$) in the diagonal axis direction of the shadow mask.

TABLE 3

| | $Ph_C$ (mm) | $Ph_D$ (mm) | $Ph_D/Ph_C$ |
|---|---|---|---|
| 25" | 0.78 | 10.32 | 1.032 |
| 28" | 0.74 | 0.999 | 1.35 |
| 29" | 0.75 | 0.970 | 1.29 |
| 32" | 0.67 | 0.898 | 1.34 |

Accordingly, as shown in Table 3, in the conventional art, a horizontal pitch ratio in the diagonal axis direction or the long axis direction to the central portion is about 1.3, when 0.67 mm$\leqq Ph_C \leqq$0.8 mm, $Ph_H/Ph_C \geqq 1.6$ and $Ph_D/Ph_C \geqq 1.6$, the horizontal pitch at the central portion increases, a definition of a screen is drastically lowered, accordingly values of $Ph_H/Ph_C$ and $Ph_D/Ph_C$ have to be not greater than 1.6.

And, if a horizontal pitch of the shadow mask increases, a radius of curvature is reduced, if a horizontal pitch decreases, a radius of curvature increases, when $Ph_H/Ph_C$ and $Ph_D/Ph_C$ are not greater than 1.2, the less the circumference portion horizontal pitch, the more the radius of curvature of the shadow mask increases. In that case, the radius of curvature is not less than 2.1 R, accordingly a stiffness characteristic of the shadow mask can not be secured.

Accordingly, the circumference portion horizontal pitch of the shadow mask has to be not less than 1.2.

In FIG. 8A, an unexplained reference number (a) is a non-visible portion by the black matrix covering the electron beam, (b) is a luminescent bright portion by the electron beam landed on a target portion, and (c) is a size of an electron beam.

Next, in order to improve a transmissivity of the shadow mask, a circumference portion horizontal pitch of the shadow mask has to be increased in the comparison with the conventional art, and simultaneously an area of each electron beam passage hole of the shadow mask has to be increased.

In the present invention, a shadow mask transmissivity is a rate of the area of the electron beam passage hole calculated by multiplying the horizontal width (Sw) by the vertical height (Sh) in the comparison with the area of the shadow mask calculated by multiplying the horizontal pitch (Ph) by the vertical pitch (Pv), when a shadow mask transmissivity is Tm, a central portion transmissivity of the shadow mask is $Tm_C$ and a circumference portion transmissivity is $Tm_D$, a $Tm_D$ satisfies 10%~20%, $Tm_D/Tm_C$ as a transmissivity rate satisfies $0.85 \leqq Tm_D/Tm_C \leqq 0.90$.

However, when an area of the electron beam passage hole is too greater than a size of the horizontal pitch and the vertical pitch of the shadow mask, a size of the electron beam is increased, in more detail, as depicted in FIGS. 8A and 8B, because a size of the electron beam passing the electron beam passage hole is too large, the electron beam lands on other fluorescent surface beyond a target fluorescent surface.

Herein, a purity margin means a margin until R, G, B three electron beams land on other fluorescent surface besides a target fluorescent surface, it is preferable to determine a transmissivity by adjusting an area of the electron beam passage hole in consideration of the purity margin.

Below Table 4 describes a central portion transmissivity and a circumference portion transmissivity by inches.

TABLE 4

| | CENTRAL PORTION (%) | CIRCUMFERENCE PORTION (%) |
|---|---|---|
| 25" | 18.9 | 15.7 |
| 28" | 17.1 | 14.2 |
| 29" | 17.6 | 15.2 |
| 32" | 18.1 | 14.7 |

As shown in Table 4, in general, the conventional flat type color cathode ray tube has a transmissivity about 15%, when it is over 20%, a size of the electron beam passage hole is increased, a color purity is decreased due to the increase of the size of an electron beam passing the electron beam passage hole, accordingly lots of color purity defection may occur in production of flat type color cathode ray tubes.

Accordingly, it is preferable to have a transmissivity of the shadow mask not greater than 20%.

In case of $Tm_D/Tm_C$ (the circumference portion transmissivity/the central portion transmissivity), it is preferable to heighten it as 0.85~0.90 greater than 0.81~0.86 in the conventional art by improving the circumference portion transmissivity.

In the meantime, 10%~20% of the electron beams radiated from the electron beam pass the shadow mask and pass the fluorescent surface 40 coated onto the internal surface of the panel.

In the fluorescent surface 40, black matrixes 41 cutting off the electron beam 60 and stripes 42 radiating R, G, B colors are coated by turns.

As depicted in FIGS. 7 and 8A, a part of the electron beams passing the shadow mask can not pass the panel 10 by being cut off by the black matrixes 41, a part of the electron beams land on the stripes 42 coated onto the internal surface of the panel and pass the panel 10 as a light format, herein a transmissivity of the light passing the panel 10 is defined as a screen transmissivity (Ts), the screen transmissivity (Ts) influences on a brightness balance.

When the screen effective surface 13 of the panel 10 is shown at the outer surface of the panel 10, the effective surface 13 of the screen consists of the black matrixes 41 shown as block and the stripes 42 coated with R or G or B fluorescence between the block matrixes 41, a screen transmissivity (Ts) means a ratio of a width of stripes 42 to the sum total adding a width of the black matrixes to the width of stripes, in the present invention, a brightness balance can be improved by maintaining a screen transmissivity at the circumference portion not less than 50%.

However, when a screen transmissivity is over 60%, it means a width of stripes is excessively increased, on the contrary, a width of black matrixes is decreased. Herein, as depicted in FIGS. 8A and 8B, because an electron beam cut off by the black matrix is easily exposed to other fluorescent surface, the color purity margin is reduced, accordingly it is preferable to have a screen transmissivity within a range of 50%~60%.

Figure 8C:
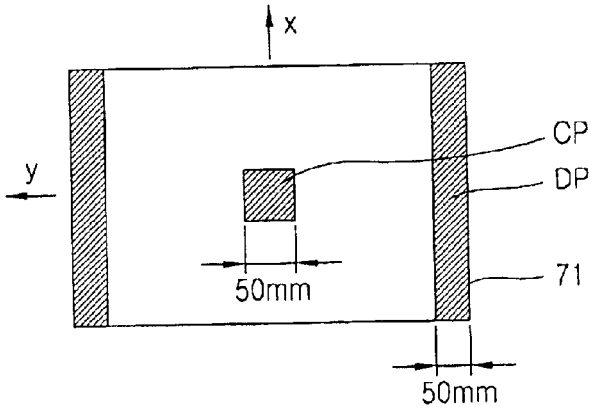
FIG. 8C CONVENTIONAL ART
FIG. 8C is a perspective view illustrating a central portion and a circumference portion within an effective surface.

As depicted in FIG. 8C, a portion placed from the center of the panel to 50 mm in width and length is the central portion (CP), a portion placed from the long axis end of the effective surface 71 to 50 mm inwards is the circumference portion (DP), $Ts_D/Ts_C$ (screen transmissivity at the circumference portion/screen transmissivity at the central portion) is 0.80~1.20, it is preferable to improve a screen transmissivity at the circumference portion.

Below Table 5 describes a screen central portion stripe width ($BM_C$) and a circumference portion stripe width ($BM_D$) by screen's inches.

TABLE 5

| | $BM_C$ (mm) | $BM_D$ (mm) | $BM_D/BM_C$ |
|---|---|---|---|
| 25" | 0.180 | 0.190 | 1.06 |
| 28" | 0.170 | 0.190 | 1.12 |
| 29" | 0.180 | 0.187 | 1.04 |

In the black matrixes 41 and the stripes 42, in the present invention, a range of $BM_D/BM_C$ is set within a range of 1.12~1.50, in other words, a width of stripes is largely increased in order to radiate more fluorescence at the circumference portion than that of the central portion in the comparison with the conventional art having a range of 1.00~1.12.

Hereinafter, the operation of the present invention will be described with 29" flat type cathode ray tube.

In a 29" flat type cathode ray tube, a panel has a diagonal length of a screen effective surface about 68 cm and an outer radius of curvature not less than 50,000 R, the outer surface of the panel is almost flat, and the inner surface of the panel has a certain radius of curvature.

Herein, a wedge rate (circumference portion glass thickness/central portion glass thickness) is 183%, a tint glass having a transmissivity of 58% is used at the central portion, and a shadow mask having a dome shape, maintaining a certain interval from the internal surface of the panel and having a plurality of electron beam passage holes on its effective surface is installed.

A radius of curvature in the long axis direction ($Rm_H$) of the shadow mask is 2.3 R, a radius of curvature in the short axis direction ($Rm_V$) is 2.0 R, a radius of curvature in the diagonal axis direction is 2.05 R. Accordingly, it is possible to satisfy stiffness and howling characteristics of the shadow mask by securing a limit impact quantity not less than 20 G as shown in Table 1.

In more detail, the radius of curvatures in the long axis, the short axis and the diagonal axis of the shadow mask satisfy below Equations.

$$Rm_D \leqq 2.1\ \mathrm{R} \tag{1}$$

$$Rm_V \leqq Rm_D \leqq Rm_H \tag{2}$$

In the shadow mask having the above-described radius of curvature, when a horizontal pitch ($Ph_C$) of an electron beam passage hole at the central portion of the shadow mask is 0.720 mm, a horizontal pitch ($Ph_H$) of the outmost electron beam passage hole in the long axis direction is 1.029 mm, a horizontal pitch ($Ph_V$) of the outmost electron beam passage hole in the short axis direction is 0.710 mm and a horizontal pitch ($Ph_D$) of the outmost electron beam passage hole in the diagonal axis direction is 1.050 mm, they satisfy below Equations.

$$0.67 \leqq Ph_C \leqq 0.8\ \mathrm{mm} \tag{3}$$

$$1.2 \leqq Ph_H/Ph_C \leqq 1.5 \tag{4}$$

$$1.2 \leqq Ph_D/Ph_C \leqq 1.5 \tag{5}$$

$$0.9 \leqq Ph_V/Ph_C < 1.1 \tag{6}$$

A central portion transmissivity of the shadow mask is 18.5%, and a circumference portion transmissivity of the shadow mask is 16.0%.

In addition, the black matrix width at the central portion is 103 μm, the fluorescent stripe width at the central portion is 150 μm, the black matrix width at the circumference portion is 185 μm, and the fluorescent stripe width at the circumference portion is 210 μm. Accordingly, $BM_D/BM_C$ is about 1.40, it is placed within a range of 1.12~1.50, a screen transmissivity ($Ts_D$) at the circumference portion is about 53%, and a screen transmissivity ($Ts_C$) at the circumference portion is about 59%.

Herein, a value of $Ts_D/Ts_C$ is 0.90.

In general, a size of the electron beam landing on the internal surface of the panel after passing the electron beam passage hole is about 1.8 times of the horizontal width (Sw) of the electron beam passage hole, when a circumference transmissivity of the shadow mask is 16%, the horizontal width (Sw) of the electron beam passage hole is about 219 μm, when an electron beam passing the electron beam passage hole having 16% transmissivity and 210 μm horizontal width (Sw) lands on the internal surface of the panel, a size of the electron beam is about 395 μm.

When a circumference screen transmissivity ($Ts_D$) is about 60%, as depicted in FIG. 8*b*, a circumference black matrix width is about 160 μm, and a circumference stripe width is about 235 μm.

Herein, a color purity margin is 80 μm, when it is not greater than 80 μm, similar to 32" case, because a color purity margin is decreased, color spread defect and yield rate reduction may occur.

Below Table 6 describes a rate of the circumference transmissivity ($Ts_D$) in the comparison with the central transmissivity ($Ts_C$) of the panel by inches.

TABLE 6

| | $Ts_D/Ts_C$ | $Ts_D$ (%) | $Ts_D$ (%) |
|---|---|---|---|
| 25" | 0.73 | 47 | 64 |
| 28" | 0.75 | 49 | 65 |
| 29" | 0.75 | 51 | 68 |
| 32" | 0.78 | 47 | 60 |

In the conventional screen transmissivity, the circumference screen transmissivity is not greater than 50% in most cases, a value of $BM_D/BM_C$ (circumference portion stripe width/central portion stripe width) is not greater than 1.10 in most cases.

Accordingly, a circumference screen transmissivity ($Ts_D$) is 50%~60%, a range of $BM_D/BM_C$ satisfies $1.12 \leqq BM_D/BM_C < 1.50$.

In the conventional 29" flat type color cathode ray tube using a tint glass and the present invention applied product, a ratio of the outmost horizontal pitch in the diagonal axis ($Ph_D$) to a central portion horizontal pitch ($Ph_C$) of the shadow mask, a shadow mask circumference portion transmissivity ($Tm_D$), a ratio of the circumference portion stripe width ($BM_D$) to the central portion stripe width ($BM_C$) of the screen, the screen circumference portion transmissivity ($Ts_D$) and the brightness balance (B/U) will be described.

TABLE 7

| | THE CONVENITONAL ART | THE PRESENT INVENTION |
|---|---|---|
| $Ph_D/Ph_C$ | 1.3 | 1.46 |
| $Tm_D$ | 15.7% | 16.0% |
| $BM_D/BM_C$ | 1.06 | 1.40 |
| $Ts_D$ | 46% | 53% |
| B/U | 45% | 52% |

The electron beam 60 radiated from the electron gun 130 reaches in eyesight after passing the electron beam passage hole 74 of the shadow mask, the fluorescent surface 40 (consisting of the black matrix 41 and the stripe 42) and the tint glass panel 10.

Herein, a brightness balance describing a rate of the circumference portion brightness in the comparison with the central portion brightness is B/U, the higher the B/U value, the more the brightness balance improves.

Accordingly, as shown in Table 7, by increasing a value of $Ph_D/Ph_C$ as a horizontal pitch ratio of a shadow mask, the circumference shadow mask transmissivity ($Tm_D$) and the circumference screen transmissivity, a brightness balance of the present invention is about 7% higher than that of the conventional flat type color cathode ray tube.

Figure 9:
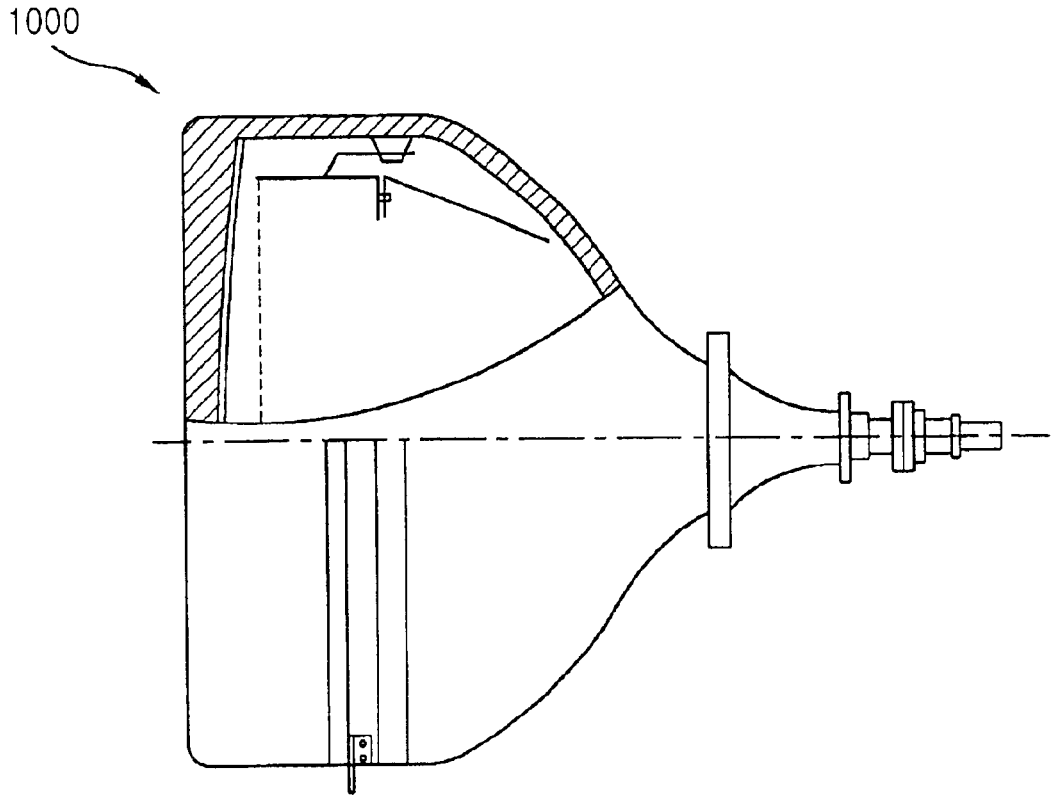
FIG. 9 is a fragmentary sectional view illustrating a flat type color cathode ray tube in accordance with the present invention.

FIG. 9 is a fragmentary sectional view illustrating a flat type color cathode ray tube(1000) in accordance with the present invention.

As described above, in using of a tint or a dark tint panel having a production process reduction advantage, by using a shadow mask having a radius of curvature capable of maintaining inner impact resistance and howling characteristics and improving a circumference portion transmissivity of the shadow mask and a circumference portion transmissivity of a screen, it is possible to improve contrast characteristics, a brightness balance and a quality of the screen.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A flat type color cathode ray rube including a rectangular panel having a substantially flat outer surface and an inner surface having a certain radius of curvature, a funnel installed to a rear of the panel, a fluorescent surface coated onto an internal surface of the panel and performing a certain fluorescence function, an electron gun discharging electron beams radiating the fluorescent surface, a shadow mask for making the electron beams from the electron gun land on a certain portion of the fluorescent surface, a frame for fixing/supporting the shadow mask, a spring and a stud pin for combining the frame assembly with the panel, an inner shield combined with the certain side of the frame from the panel side to the funnel side in order to protect the cathode ray tube against a terrestrial magnetism, an electron gun placed inside a neck portion of the funnel and generating the electron beams, a deflection yoke installed to the outer surface of the neck portion of the funnel in order to deflect the electron beams from the electron gun in a certain direction, a CPM (convergence & purity magnet) for precisely adjusting the deflected direction of the electron beams and a reinforcing band installed to the outer circumference of the portion at which the panel and the funnel are combined in order to protect the panel and the funnel against an air pressure and external impacts, wherein the flat type color cathode ray tube satisfies the following equations:

$$1.2 \leqq Ph_H/Ph_C \leqq 1.6,$$

$$0.9 \leqq Ph_V/Ph_C < 1.0 \text{ or } 1.0 < Ph_V/Ph_C \leqq 1.1,$$

$$1.2 \leqq Ph_D/Ph_C \leqq 1.6$$

where a central portion glass transmissivity of the panel is about 45%~75%, a radius of curvature in the diagonal direction ($Rp_D$) of the panel has a range of $3.5\ R \leqq Rp_D \leqq 8.0\ R$ (R is calculated by multiplying 1.767 by an effective surface diagonal axis length of the panel), $Ph_C$ is a horizontal pitch of an electron beam passage hole at the central portion of the shadow mask, $Ph_H$ is a horizontal pitch of the outmost electron beam passage hole in the long axis direction of the shadow mask, $Ph_V$ is a horizontal pitch of the outmost electron beam passage hole in the short axis direction of the shadow mask, and $Ph_D$ is a horizontal pitch of the outmost electron beam passage hole in the diagonal axis direction of the shadow mask.

2. The flat type color cathode ray tube of claim 1, wherein a diagonal length of the screen effective surface of the panel is 55 cm.

3. The flat type color cathode ray tube of claim 1, wherein the horizontal pitch of the electron beam passage hole at the central portion of the shadow mask $Ph_C$ satisfies the following equation:

$$0.67 \text{ mm} \leqq Ph_C \leqq 0.8 \text{ mm}.$$

4. The flat type color cathode ray tube of claim 1, wherein a transmissivity of the shadow mask satisfies the following equation:

$$0.85 \leqq Tm_D/Tm_C \leqq 0.9$$

where $Tm_D$ is a circumference portion transmissivity of the shadow mask and $Tm_C$ is a central portion transmissivity of the shadow mask.

5. The flat type color cathode ray tube of claim 4, wherein the shadow mask satisfies the following equation:

$$10\% \leqq Tm_D \leqq 20\%$$

where $Tm_D$ is the circumference portion transmissivity of the shadow mask.

6. The flat type color cathode ray tube of claim 1, wherein the panel satisfies the following equation:

$$0.80 \leqq Ts_D/Ts_C \leqq 1.20$$

where $Ts_D$ is a circumference portion screen transmissivity of the effective surface of the panel and $Ts_C$ is a central portion screen transmissivity of the effective surface of the panel.

7. The flat type color cathode ray tube of claim 1, wherein the circumference portion screen transmissivity of the panel is within a range of $50\% \leqq Ts_D \leqq 60\%$.

8. A flat type color cathode ray tube including a rectangular panel having a substantially flat outer surface and an inner surface having a certain radius of curvature, a funnel installed to a rear of the panel, a fluorescent surface coated onto an internal surface of the panel and performing a certain fluorescence function, an electron gun discharging electron beams radiating the fluorescent surface, a shadow mask for making the electron beams from the electron gun land on a certain portion of the fluorescent surface, a frame for fixing/supporting the shadow mask, a spring and a stud pin for combining the frame assembly with the panel, an inner shield combined with the certain side of the frame from the panel side to the funnel side in order to protect the cathode ray tube against a terrestrial magnetism, an electron gun placed inside a neck portion of the funnel and generating the electron beams, a deflection yoke installed to the outer surface of the neck portion of the funnel in order to deflect the electron beams from the electron gun in a certain direction, a CPM (convergence & purity magnet) for precisely adjusting the deflected direction of the electron beams and a reinforcing band installed to the outer circumference of the portion at which the panel and the funnel are combined in order to protect the panel and the funnel against an air pressure and external impacts, wherein the flat type color cathode ray tube satisfies the following equations:

$$1.2 \leqq Ph_H/Ph_C \leqq 1.6,$$

$$1.2 \leqq Ph_D/Ph_C \leqq 1.6$$

where a central portion glass transmissivity of the panel is about 45%~75%, a radius of curvature in the diagonal direction ($Rp_D$) of the panel has a range of $3.5\ R \leqq Rp_D \leqq 8.0\ R$ (R is calculated by multiplying 1.767 by an effective surface diagonal axis length of the panel), $Ph_C$ is a horizontal pitch of an electron beam passage hole at the central portion of the shadow mask, $Ph_H$ is a horizontal pitch of the outmost electron beam passage hole in the long axis direction of the shadow mask, and $Ph_D$ is a horizontal pitch of the outmost electron beam passage hole in the diagonal axis direction of the shadow mask, wherein the shadow mask satisfies the following equations:

$$Rm_D \leqq 2.1\ R,$$

$$Rm_V < Rm_D < Rm_H$$

where $Rm_H$ is a radius of curvature in the long axis direction of the shadow mask, $Rm_V$ is a radius of curvature in the short axis direction of the shadow mask and $Rm_D$ is a radius of curvature in the diagonal direction of the shadow mask.

9. A flat type color cathode ray tube including a rectangular panel having a substantially flat outer surface and an inner surface having a certain radius of curvature, a funnel installed to a rear of the panel, a fluorescent surface coated onto an internal surface of the panel and performing a certain fluorescence function, an electron gun discharging electron beams radiating the fluorescent surface, a shadow mask for making the electron beams from the electron gun land on a certain portion of the fluorescent surface, a frame for fixing/supporting the shadow mask, a spring and a stud pin for combining the frame assembly with the panel, an inner shield combined with the certain side of the frame from the panel side to the funnel side in order to protect the cathode ray tube against a terrestrial magnetism, an electron gun placed inside a neck portion of the funnel and generating the electron beams, a deflection yoke installed to the outer surface of the neck portion of the funnel in order to deflect the electron beams from the electron gun in a certain direction, a CPM (convergence & purity magnet) for precisely adjusting the deflected direction of the electron beams and a reinforcing band installed to the outer circumference of the portion at which the panel and the funnel are combined in order to protect the panel and the funnel against an air pressure and external impacts, wherein the flat type color cathode ray tube satisfies the following equations:

$$1.2 \leqq Ph_H/Ph_C \leqq 1.6,$$

$$1.2 \leqq Ph_D/Ph_C \leqq 1.6$$

where a central portion glass transmissivity of the panel is about 45%~75%, a radius of curvature in the diagonal direction ($Rp_D$) of the panel has a range of $3.5\ R \leqq Rp_D \leqq 8.0\ R$ (R is calculated by multiplying 1.767 by an effective surface diagonal axis length of the panel), $Ph_C$ is a horizontal pitch of an electron beam passage hole at the central portion of the shadow mask, $Ph_H$ is a horizontal pitch of the outmost electron beam passage hole in the long axis direction of the shadow mask, and $Ph_D$ is a horizontal pitch of the outmost electron beam passage hole in the diagonal axis direction of the shadow mask, wherein the panel satisfies the following equation:

$$1.12 \leqq BM_D/BM_C \leqq 1.5$$

where $BM_D$ is a black matrix circumference portion stripe width of the effective surface of the panel and $BM_C$ is a black matrix central portion stripe width of the effective surface of the panel.

10. A flat type color cathode ray tube including a rectangular panel having a substantially flat outer surface and an inner surface of a certain radius of curvature, a funnel installed to a rear of the panel, a fluorescent surface coated onto an internal surface of the panel and performing a certain fluorescence function, an electron gun discharging electron beams radiating the fluorescent surface, a shadow mask for making the electron beams from the electron gun land on certain portion of the fluorescent surface, a frame for fixing/supporting the shadow mask, a spring and stud pin for combining the frame assembly with the panel, an inner shield combined with the certain side of the frame from the panel side to the funnel side in order to protect the cathode ray tube against a terrestrial magnetism, an electron gun placed inside a neck portion of the funnel and generating the electron beams, a deflection yoke installed to the outer surface of the neck portion of the funnel in order to deflect the electron beams from the electron gun in a certain direction, a CPM (convergence & purity magnet) for precisely adjusting the deflected direction of the electron beams and a reinforcing band installed to the outer circumference of the portion at which the panel and the funnel are combined in order to protect the panel and the funnel against an air pressure and external impacts, wherein the flat type color cathode ray tube satisfies the following equation:

$$0.80 \leqq Ts_D/Ts_C \leqq 1.20$$

where a central portion glass transmissivity of the panel is about 45%~75%, a radius of curvature in the diagonal direction ($Rp_D$) of the panel is within a range of 3.5 $R \leqq Rp_D \leqq 8.0$ R (R is calculated by multiplying 1.767 by an effective surface diagonal axis length of the panel), $Ts_D$ is a circumference portion screen transmissivity of the effective surface of the panel and $Ts_C$ is a central portion screen transmissivity of the effective surface of the panel, wherein the panel satisfies the following equation:

$$1.12 \leqq BM_D/BM_C \leqq 1.5$$

where $BM_D$ is a black matrix circumference portion stripe width of the effective surface of the panel and $BM_C$ is a black matrix central portion stripe width of the effective surface of the panel.

11. The flat type color cathode ray tube of claim 10, wherein the circumference portion screen transmissivity of the panel ($Ts_D$) is within a range of $50\% \leqq Ts_D \leqq 60\%$.

12. The flat type color cathode ray tube of claim 10, wherein a diagonal length of the screen effective surface of the panel is 55 cm.

13. A flat type color cathode ray tube, comprising:

a panel having a substantially flat outer surface and an inner surface having a predetermined radius of curvature; and a shadow mask configured to guide electron beams received from an electron gun onto a fluorescent surface of the panel, wherein the flat type color cathode ray tube satisfies the following equations:

$$1.2 \leqq Ph_H/Ph_C \leqq 1.6,$$

$$0.9 \leqq Ph_V/Ph_C < 1.0 \text{ or } 1.0 < Ph_V/Ph_C \leqq 1.1,$$

$$1.2 \leqq Ph_D/Ph_C \leqq 1.6$$

where a central portion glass transmissivity of the panel is about 45%~75%, a radius of curvature in the diagonal direction ($Rp_D$) of the panel has a range of 3.5 $R \leqq Rp_D \leqq 8.0$ R (R is calculated by multiplying 1.767 by an effective surface diagonal axis length of the panel), $Ph_C$ is a horizontal pitch of an electron beam passage hole at the central portion of the shadow mask, $Ph_H$ is a horizontal pitch of the outmost electron beam passage hole in the long axis direction of the shadow mask, $Ph_V$ is a horizontal pitch of the outmost electron beam passage hole in the short axis direction of the shadow mask, and $Ph_D$ is a horizontal pitch of the outmost electron beam passage hole in the diagonal axis direction of the shadow mask.

14. The flat type color cathode ray tube of claim 13, wherein a diagonal length of a screen effective surface of the panel is 55 cm.

15. The flat type color cathode ray tube of claim 13, wherein the horizontal pitch of the electron beam passage hole at the central portion of the shadow mask, $Ph_C$, satisfies the following equation:

$$0.67 \text{ mm} \leqq Ph_C \leqq 0.8 \text{ mm}.$$

16. The flat type color cathode ray tube of claim 13, wherein a transmissivity of the shadow mask satisfies the following equation:

$$0.85 \leqq Tm_D/Tm_C \leqq 0.9$$

where $Tm_D$ is a circumference portion transmissivity of the shadow mask and $Tm_C$ is a central portion transmissivity of the shadow mask.

17. The flat type color cathode ray tube of claim 16, wherein the shadow mask satisfies the following equation:

$$10\% \leqq Tm_D \leqq 20\%$$

where $Tm_D$ is the circumference portion transmissivity of the shadow mask.

18. The flat type color cathode ray tube of claim 13, wherein the panel satisfies the following equation:

$$0.80 \leqq Ts_D/Ts_C \leqq 1.20$$

where $Ts_D$ is a circumference portion screen transmissivity of the effective surface of the panel and $Ts_C$ is a central portion screen transmissivity of the effective surface of the panel.

19. The flat type color cathode ray tube of claim 13, wherein the circumference portion screen transmissivity of the panel is within a range of $50\% \leqq Ts_D \leqq 60\%$.

20. A flat type color cathode ray tube, comprising:

a panel having a substantially flat outer surface and an inner surface having a predetermined radius of curvature; and a shadow mask configured to guide electron beams received from an electron gun onto a fluorescent surface of the panel, wherein the flat type color cathode ray tube satisfies the following equations:

$$1.2 \leqq Ph_H/Ph_C \leqq 1.6,$$

$$1.2 \leqq Ph_D/Ph_C \leqq 1.6$$

where a central portion glass transmissivity of the panel is about 45%~75%, a radius of curvature in the diagonal direction ($Rp_D$) of the panel has a range of 3.5 $R \leqq Rp_D \leqq 8.0$ R (R is calculated by multiplying 1.767 by an effective surface diagonal axis length of the panel), $Ph_C$ is a horizontal pitch of an electron beam passage hole at the central portion of the shadow mask, $Ph_H$ is a horizontal pitch of the outmost electron beam passage hole in the long axis direction of the shadow mask, and $Ph_D$ is a horizontal pitch of the outmost electron beam passage hole in the diagonal axis direction of the shadow mask, wherein the shadow mask satisfies the following equations:

$$Rm_D \leqq 2.1 \text{ R},$$

$$Rm_V < Rm_D < Rm_H$$

where $Rm_H$ is a radius of curvature in the long axis direction of the shadow mask, $Rm_V$ is a radius of curvature in the short axis direction of the shadow mask, and $Rm_D$ is a radius of curvature in the diagonal direction of the shadow mask.

21. A flat type color cathode ray tube, comprising:

a panel having a substantially flat outer surface and an inner surface having a predetermined radius of curvature; and a shadow mask configured to guide electron beams received from an electron gun onto a fluorescent surface of the panel, wherein the flat type color cathode ray tube satisfies the following equations:

$$1.2 \leqq Ph_H/Ph_C \leqq 1.6,$$

$$1.2 \leqq Ph_D/Ph_C \leqq 1.6$$

where a central portion glass transmissivity of the panel is about 45% ~75%, a radius of curvature in the diagonal direction ($Rp_D$) of the panel has a range of 3.5 $R \leqq Rp_D \leqq 8.0$ R (R is calculated by multiplying 1.767 by an effective surface diagonal axis length of the panel), $Ph_C$ is a horizontal pitch of an electron beam passage hole at the central portion of the shadow mask, $Ph_H$ is a horizontal pitch of the outmost electron beam passage hole in the long axis direction of the shadow mask, and $Ph_D$ is a horizontal pitch of the outmost electron beam passage hole in the diagonal axis direction of shadow mask, wherein the panel satisfies the following equation:

$$1.12 \leqq BM_D/BM_C \leqq 1.5$$

where $BM_D$ is a black matrix circumference portion stripe width of the effective surface of the panel and $BM_C$ is a black matrix central portion stripe width of the effective surface of the panel.

22. A flat type color cathode ray tube, comprising:

a panel having a substantially flat outer surface and an inner surface of a certain radius of curvature; and a shadow mask configured to guide electron beams from an electron gun onto a fluorescent surface of the panel, wherein the flat type color cathode ray tube satisfies the following equation:

$$0.80 \leqq Ts_D/Ts_C \leqq 1.20$$

where a central portion glass transmissivity of the panel is about 45%~75%, a radius of curvature in the diagonal direction ($Rp_D$) of the panel is within a range of 3.5 $R \leqq Rp_D \leqq 8.0$ R (R is calculated by multiplying 1.767 by an effective surface diagonal axis length of the panel), $Ts_D$ is a circumference portion screen transmissivity of the effective surface of the panel and $Ts_C$ is a central portion screen transmissivity of the effective surface of the panel, wherein the panel satisfies the following equation:

$$1.12 \leqq BM_D/BM_C \leqq 1.5$$

where $BM_D$ is a black matrix circumference portion stripe width of the effective surface of the panel, and $BM_C$ is a black matrix central portion stripe width of the effective surface of the panel.

23. The flat type color cathode ray tube of claim 22, wherein the circumference portion screen transmissivity of the panel ($Ts_D$) is within a range of $50\% \leqq TS_D \leqq 60\%$.

24. The flat type color cathode ray tube of claim 22, wherein a diagonal length of the screen effective surface of the panel is 55 cm.

* * * * *